US005880753A

United States Patent [19]

Ikeda et al.

[11] Patent Number: 5,880,753

[45] Date of Patent: Mar. 9, 1999

[54] TEMPERATURE COMPENSATION APPARATUS AND RECORDING HEAD AND APPARATUS USING THE SAME

[75] Inventors: Masami Ikeda, Tokyo; Seiichiro Karita, Yokohama, both of Japan

[73] Assignee: Canon Kabushiki Kaisha, Tokyo, Japan

[21] Appl. No.: 411,405

[22] Filed: Mar. 28, 1995

Related U.S. Application Data

[63] Continuation of Ser. No. 19,920, Feb. 19, 1993, abandoned, which is a continuation of Ser. No. 942,341, Sep. 9, 1992, abandoned, which is a continuation of Ser. No. 653,899, Feb. 12, 1991, abandoned.

[30] Foreign Application Priority Data

Feb. 19, 1990 [JP] Japan ..... 2-036193

[51] Int. Cl.[6] ..... B41J 2/05

[52] U.S. Cl. ..... 347/17; 347/186

[58] Field of Search ..... 347/17, 186, 185, 347/60, 102, 14

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,417,251 | 11/1983 | Sugitani | 347/65 |
| 4,459,600 | 7/1984 | Sato et al. . | |
| 4,463,359 | 7/1984 | Ayata et al. . | |
| 4,539,571 | 9/1985 | Suzuki | 346/76 PH |
| 4,558,333 | 12/1985 | Sugitani et al. . | |
| 4,719,472 | 1/1988 | Arakawa | 347/17 X |
| 4,723,129 | 2/1988 | Endo et al. . | |
| 4,740,796 | 4/1988 | Endo et al. . | |
| 4,746,937 | 5/1988 | Luc et al. | 347/17 X |
| 4,791,435 | 12/1988 | Smith | 347/17 |
| 4,896,172 | 1/1990 | Nozawa | 347/17 |
| 4,899,180 | 2/1990 | Eihatem et al. | 347/17 X |
| 4,929,964 | 5/1990 | Sato et al. | 347/62 |
| 4,980,702 | 12/1990 | Kneezel | 347/17 |
| 5,175,565 | 12/1992 | Ishinaga | 347/17 X |

FOREIGN PATENT DOCUMENTS

| | | | |
|---|---|---|---|
| 0353925 | 2/1990 | European Pat. Off. | B41J 2/16 |
| 2843064 | 4/1979 | Germany | B41J 3/04 |
| 54-51837 | 4/1979 | Japan | B41J 3/04 |
| 54-56847 | 5/1979 | Japan | B41M 5/26 |
| 56-62170 | 5/1981 | Japan | B41J 3/20 |
| 59-123670 | 7/1984 | Japan | B41J 3/04 |
| 59-138461 | 8/1984 | Japan | B41J 3/04 |
| 60-71260 | 4/1985 | Japan | B41J 3/04 |
| 61-126571 | 6/1986 | Japan | G03G 15/00 |
| 61-272811 | 12/1986 | Japan | G05D 23/24 |
| 62-167054 | 2/1987 | Japan | B41J 3/04 |
| 62-85959 | 4/1987 | Japan | B41J 3/20 |
| 117754 | 5/1987 | Japan | B41J 3/04 |
| 62-173259 | 7/1987 | Japan | B41J 3/04 |
| 63-41153 | 2/1988 | Japan | B41J 3/04 |
| 63-100771 | 6/1988 | Japan | G03G 21/00 |
| 63-134252 | 6/1988 | Japan | B41J 3/04 |
| 1-139281 | 5/1989 | Japan | B41J 3/20 |
| 1299045 | 12/1989 | Japan | B41J 3/04 |
| 2-307756 | 12/1990 | Japan | B41J 2/175 |
| 2208829 | 4/1989 | United Kingdom | B41J 3/04 |
| 2218380 | 11/1989 | United Kingdom | B41J 3/04 |

OTHER PUBLICATIONS

Drake, Xerox Disclosure Journal, "Ink Temperature Control For Continuous Ink Jet Using Thin Film Resistors", No. 3, May/Jun. 1988.

*Primary Examiner*—Joseph Hartary
*Attorney, Agent, or Firm*—Fitzpatrick, Cella, Harper & Scinto

[57] ABSTRACT

In a liquid discharging recording head having recording liquid discharging heaters for generating an energy for discharging the recording liquid and a plurality of compensating heaters for heating recording liquid, both of which are disposed on the same substrate, the plurality of compensating heaters are selectively energized in response to an output from a thermistor for sensing a temperature of the recording liquid, the energization of the compensating heaters is interrupted when a temperature of the substrate exceeds a predetermined temperature, thereby attaining temperature compensation of the recording head.

77 Claims, 9 Drawing Sheets

TEMPERATURE COMPENSATION APPARATUS AND RECORDING HEAD AND APPARATUS USING THE SAME

This application is a continuation of application Ser. No. 08/019,920 filed Feb. 19, 1993, now abandoned, which was a continuation of application Ser. No. 07/942,341 filed Sep. 9, 1992, now abandoned, which was a continuation of application Ser. No. 07/653,899 filed Feb. 12, 1991, now abandoned.

BACKGROUND OF THE INVENTION

1. Field of the Invention

The present invention relates generally to a liquid discharging or ejecting recording head of the type in which a heat energy is applied to a recording liquid so that the recording liquid is converted into liquid droplets which in turn are discharged or ejected from the recording head in order to record data and more particularly to a liquid discharging or ejecting head in which a temperature of such a head is compensated.

2. Description of the Prior Art

Liquid discharging or ejecting recording methods such as a so-called ink jet recording method have recently been attracting an increasing interest because noise produced at the time of recording is almost negligible; a high speed recording is possible; and the liquid discharging or ejecting recording is made on plain paper without requiring any special fixing process.

Of these methods, the liquid discharging recording method disclosed in Japanese Patent Application Laying-open No. 54-51837 and German Patent Application Laying-open (DOLS) No. 2843064 has a feature different from the other methods especially in that a thermal energy is applied to recording liquid so as to obtain an energy for jetting liquid droplets.

More particularly, according to this method, when recording liquid is actuated by a thermal energy, the recording liquid changes its state, involving rapid expansion of a volume of the recording liquid. As a result of this change of state, the recording liquid is ejected from an orifice such as a liquid discharging opening positioned at the end of the recording head by a force based upon the change of the state to form a frying droplet. The frying droplet lands on a recording medium such as recording paper, so that recording is made on the paper.

The liquid discharging recording method of the type disclosed in DOLS No. 2843064 is advantageously applied to a so-called drop-on demand recording method. Furthermore, according to this method, a recording head with a high degree of multi-orifice in the form of a full line can be easily constructed. Thus, the liquid recording head has a feature in that a high quality image with a high degree of resolution can be obtained at a high speed.

A recording head used in a recording apparatus constructed according to the above-mentioned method includes, in general, a liquid discharging portion having a plurality of orifices each of which ejects recording liquid to form a frying droplet and a plurality of recording liquid passages which partially have a thermal energy application portion for applying a thermal energy for discharging a droplet to the recording liquid; and means for generating the thermal energy.

So far, a liquid discharging recording head is constructed in the manner described above. Such a head, however, has various problems to be solved as will be described below.

Firstly, some problems are caused by temperature characteristics of the liquid discharging recording head. Concerning a relation of a size of a recording dot formed by a recording liquid droplet landed on recording paper, i.e., a dot diameter with a temperature of the recording head, the dot diameter is closely dependent upon a temperature of the recording head. The reason is that in accordance with variations in temperature of the recording head, an initial bubble forming force required for forming a recording liquid droplet varies over a wide range. Especially when the temperature is low, the initial bubble forming force applied to the recording liquid is small, so that a frying recording liquid droplet cannot be formed in a stable manner. As a result, it is impossible to obtain a high quality dot image.

In order to overcome this problem, so far an external heating type heater such as a positive characteristic thermistor is used to heat the entire recording head from the exterior of the head. According to this method, however, the whole recording head is heated so that there are problems that power consumption is higher and that the response speed of temperature rise response is slow.

Furthermore, a liquid discharging head which utilizes thermal energy involves self-heating in principle and the recording liquid flows over a substrate so that the substrate is cooled. As a result, a temperature distribution of the head is complicated. As a consequence, in the case of a liquid discharging recording head of the type having a plurality of nozzles (a multi-orifice liquid discharging recording head), it is imperative to uniform the temperature distribution and to improve the characteristics of the recording head at a low temperature in order to obtain a high quality image.

With the above in view, it has been proposed to arrange integrally heating means such as a compensating heater for temperature compensation on a heater board as a substrate having thereon thermal energy generating means for discharging the recording liquid, for example, a discharging heater, thereby increasing a thermal transmission efficiency and accordingly decreasing electric power consumption and enhancing the response speed.

When the discharging heater and the compensating heater are disposed on the heater board in closely spaced relationship in the manner described above, the thermal energy transmission efficiency is improved so that a temperature rise time required for a temperature compensation starting from low temperature is greatly different from a temperature rise time required for a temperature compensation starting from room temperature. In addition, a temperature rise time at a starting time that an electric power source is turned on to start using the recording head is different from a temperature rise time at a waiting time after a series of recording operations are terminated. In other words, a time period required for temperature compensation varies in response to an environmental temperature and an operation condition of the printer. It follows, therefore, that if a heating operation is carried out uniformly regardless of the starting time or the waiting time, for instance, the waiting time for the recording processing is excessively elongated due to the uniform heating operation, so that there is the possibility that printing errors occur.

In order to solve the above-mentioned problem, it can be proposed to provide a temperature sensor and means for varying an electrical energy to be applied to the compensating heater in response to a detection signal from the temperature sensor. This solution, however, involves a problem that the cost of the recording head is expensive. It can also be proposed to apply an over power to the compensating heater so that a waiting time can be reduced under any condition of the recording head. There arises, however, another problem from the standpoint of durability of the compensating heater and its energy consumption.

SUMMARY OF THE INVENTION

In view of the above, it is a first object of the present invention to provide a liquid discharging recording head whose temperature compensation is optimally carried out so that even at a low temperature a high quality data image can be obtained at a high speed as in the case of temperature compensation at room temperature.

It is a second object of the present invention to provide a liquid discharging recording head whose temperature can be compensated in an inexpensive manner.

It is a third object of the present invention to provide a liquid discharging recording head whose temperature compensation can be carried out with less electric power consumption.

It is a fourth object of the present invention to provide a liquid discharging recording head in which the head is heated in accordance with a temperature related to recording liquid without requiring complicated control and accordingly an electric power consumption can be varied, so that a temperature of the recording head can be efficiently compensated.

In the first aspect of the present invention, a temperature compensation apparatus for a liquid discharging recording head comprises:

a heating means disposed on a substrate on which energy generating elements for generating an energy for discharging ink is disposed, for heating the ink;

a plurality of heating elements disposed on a substrate on which for generating an energy for discharging recording liquid is disposed, for heating the recording liquid the plurality of heating elements being selectively energized;

a sensor means for sensing a temperature related to the recording liquid; and a drive means for selectively energizing the plurality of heating elements in response to an output from the sensor means.

Here, the energy generating means may have one or more electrothermal conversion elements and the plurality of heating elements may be made of a material which is the same as at least a part of materials of the electrothermal conversion elements.

A part of the materials may be heat generating resistance layer.

The plurality of heating elements may be disposed in the vicinity of the energy generating means.

The plurality of heating elements may be disposed on both sides of the energy generating means on the substrate.

The plurality of heating elements may be disposed immediately under the energy generating means.

The sensor means may include one thermistor.

The temperature compensation apparatus may further comprise:

comparator means for comparing an output voltage derived from the thermistor with a reference voltage; and control means for controlling the energization of the plurality of heating elements in response to an output from the comparator means.

The temperature compensation apparatus may further comprise:

means for interrupting the plurality of heating elements when a temperature of the substrate exceeds a predetermined temperature.

The temperature compensation apparatus may further comprise:

a second thermistor for sensing a temperature of the substrates; and second control means for comparing an output from the second thermistor with a second reference voltage to control the interruption of the plurality of heating elements in response to a result of a comparison of the output from the second thermistor with the second reference voltage.

The temperature compensation apparatus may further comprise:

comparator means for comparing an output from the thermistor with a plurality of reference voltage; and control means for controlling the energization of the plurality of heating elements in response to an output from the comparator means.

The temperature compensation apparatus may further comprise:

means for interrupting the plurality of heating elements when a temperature of the substrate exceeds a predetermined temperature.

In the second aspect of the present invention, a temperature compensation apparatus for ink jet recording head comprises:

a heating means disposed on a substrate on which energy generating elements for generating an energy for discharging ink is disposed, for heating the ink;

a sensor means for sensing a temperature related to the ink; and a drive means for driving the heating means in different drive modes in accordance with a temperature sensing output from the sensor means.

Here, the heating means may include a plurality of heating elements.

The drive means selectively may drive the plurality of heating elements, and heating elements to be selectively driven may be different from each other in accordance with respective drive modes.

The energy generating means may have one or more electrothermal conversion elements and the plurality of heating elements may be made of a material which is the same as at least a part of materials of the electrothermal conversion elements.

A part of the materials may be heat generating resistance layer.

The plurality of heating elements may be disposed in the vicinity of the energy generating means.

The plurality of heating elements may be disposed on both sides of the energy generating means on the substrate.

The plurality of heating elements may be disposed immediately under the energy generating means.

The sensor means may include one thermistor.

The temperature compensation apparatus may further comprise:

comparator means for comparing an output voltage derived from the thermistor with a reference voltage; and control means for controlling the energization of the plurality of heating elements in response to an output from the comparator means.

The temperature compensation apparatus may further comprise:

means for interrupting the plurality of heating elements when a temperature of the substrate exceeds a predetermined temperature.

The temperature compensation apparatus may further comprise:

a second thermistor for sensing a temperature of the substrates; and second control means for comparing an output from the second thermistor with a second reference voltage to control the interruption of the plurality of heating elements in response to a result of a comparison of the output from the second thermistor with the second reference voltage.

The temperature compensation apparatus may further comprise:

comparator means for comparing an output from the thermistor with a plurality of reference voltage; and control means for controlling the energization of the plurality of heating elements in response to an output from the comparator means.

The temperature compensation apparatus may further comprise:

means for interrupting the plurality of heating elements when a temperature of the substrate exceeds a predetermined temperature.

The above and other objects, effects, features and advantages of the present invention will become more apparent from the following description of embodiments thereof taken in conjunction with the accompanying drawings.

Now the present invention will become more apparent from the following description of some preferred embodiments thereof taken in conjunction with the accompanying drawings.

DETAILED DESCRIPTION OF PREFERRED EMBODIMENTS

Figure 8:
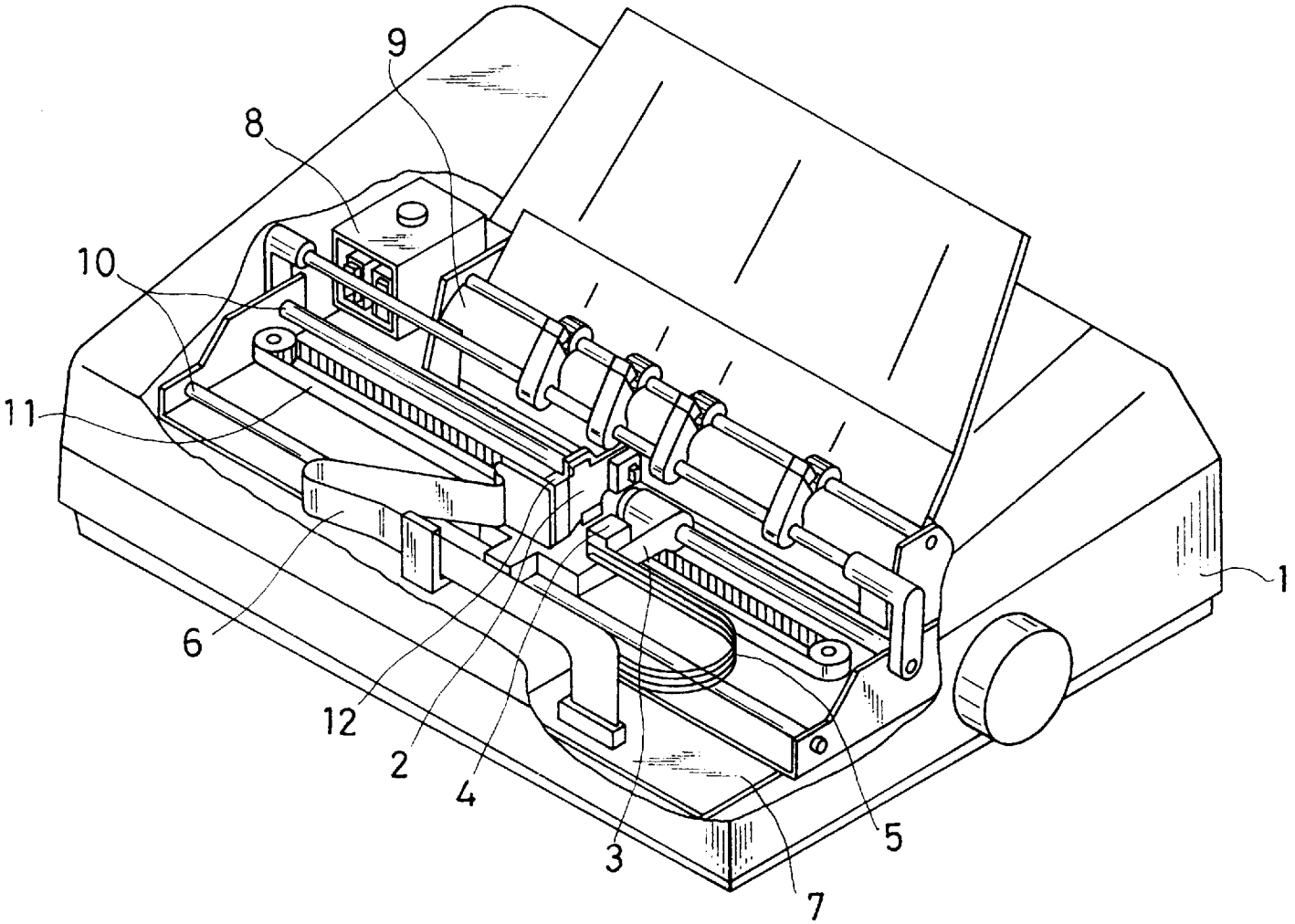
FIG. 8 is a schematic perspective view showing a recording head structure which is conventional in appearance and which can be used with an embodiment of a liquid discharging recording apparatus in accordance with the present invention.

FIG. 8 is a schematic perspective view showing an embodiment of a liquid discharging or ejecting recording apparatus having a liquid discharging ejecting recording head which utilizes a thermal energy as an energy for discharging liquid in accordance with the present invention. Typically, the apparatus is applicable to an ink jet recording apparatus.

In FIG. 8, reference numeral 1 denotes an embodiment of a liquid discharging recording apparatus in accordance with the present invention. Reference numeral 2 denotes a liquid discharging recording head which is mounted on a carriage 3 which is carried along a sliding shaft 10 and scanned in the direction of the shaft 10 by a carriage drive motor or CR motor (not shown) and a carriage drive belt 11. Electrical signal from a main board 7 are supplied to the recording head 2 via a flexible printed circuit board (FPC). Recording liquid, for instance ink, is fed to the recording head 2 via an ink feeding tube 5 and an ink subtank 4 on the carriage 3 from an ink cartridge (not shown).

On rare occasions, discharging failure of the recording head 2 occurs due to inclusion of air bubbles or adhesion of the recording liquid to the surface of the discharging orifice. With this in view, a suction recovery mechanism is disposed at a home position of the carriage 3. A recording medium such as paper is fed upward along the surface of a platen 9 by a paper feed motor or LF motor (not shown). While the recording medium is moved intermittently in a paper feed direction, i.e., in a subscanning direction, the recording head 2 is moved in a direction of the shaft 10, i.e., in a main scanning direction to perform recording on the recording medium.

First, the first embodiment of a liquid discharging recording head in accordance with the present invention will be explained with reference to FIG. 1 which schematically illustrates the portion of a heater board adjacent to a heater in the recording head.

Figure 1:
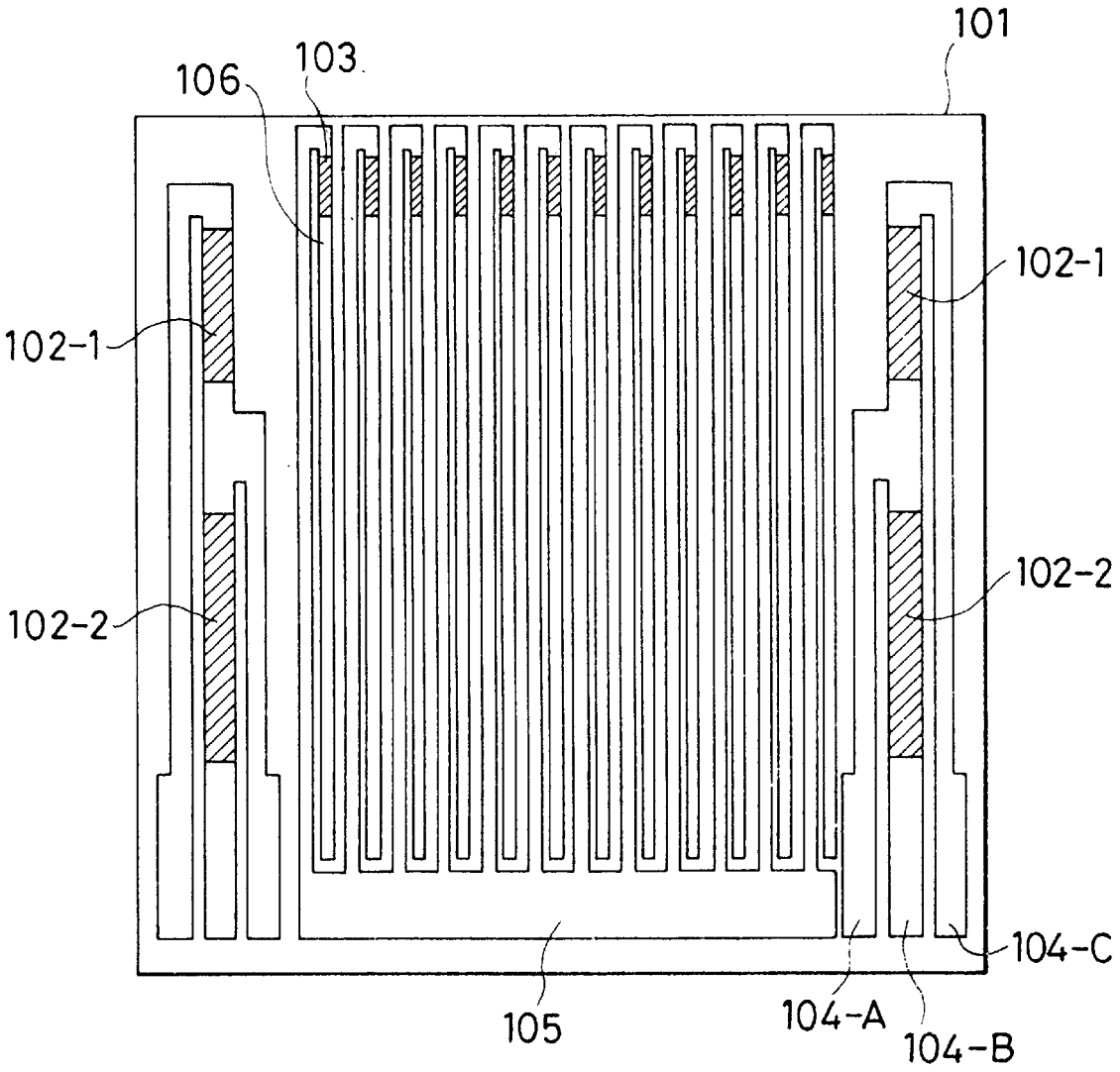
FIG. 1 is a plan view showing a heater board of a first embodiment of a liquid discharging recording head in accordance with the present invention.

In the first embodiment shown in FIG. 1, reference numeral 101 denotes a heater board or a chip, on which a plurality of liquid discharging or ejecting heaters 103 as thermal energy generating means for discharging or ejecting recording liquid, a common electrode 105 and a plurality of electrodes 106 are arranged. The electrodes 105 and 106 apply the recording signals to the discharging heaters 103 in accordance with image information to be recorded. The number of the electrodes 106 corresponds to the number of dots corresponding to a recording density of an image to be recorded. The common electrode 105 is commonly connected to all the thermal energy generating heaters 103. The electrodes 106 are selection electrodes for selectively energizing the thermal energy generating heaters 103 independently of each other.

A plurality of heaters 102-1 and 102-2 for heating the recording liquid are disposed on the same heater board 101 in order to accomplish the temperature compensation of the recording head. The temperature compensation heaters 102-1 and 102-2 are so formed in size and shape that the heaters 102-1 and 102-2 have different resistance values $R_1$ and $R_2$ ($R_1<R_2$). More specifically, the size and the shape of the heaters 102-1 and 102-2 are determined in such a way that when the same voltage is applied across the heaters 102-1 and 102-2, a thermal energy generated by the heater 102-1 is larger than that generated by the heater 102-2. Here, the heater 102-1 is connected to a common electrode 104-A and a selection electrode 104-C. The heater 102-2 is connected to the common electrode 104-A and a selection electrode 104-B. An electric power is supplied to the heaters 102-1 and 102-2 via the electrodes 104-A and 104-C and via the electrodes 104-A and 104-B, respectively. A temperature rise character of the head can be suitably determined by selecting selection electrodes 104-B and 104-C.

In the first embodiment, the temperature compensation heaters 102-1 and 102-2 can be formed by the same material as heat generating layers of the liquid discharging heaters 103 (for instance, $HfB_2$). Alternatively, the heaters 102-1 and 102-2 can be also formed by any other suitable material forming the heater board such as aluminum, tantalum, titan or the like. Aluminum is used to fabricate the electrodes. Titanium is used as a material which is interposed between the heat generating resistance layer of the discharging heater 103 and the electrode in order to enhance the adhesion therebetween. Tantalum is disposed on the heat generating resistance layer in order to increase its anti-cavitation characteristic. When these materials are selected, the temperature compensation heaters 102-1 and 102-2 can be fabricated simultaneously with the recording liquid discharging heaters 103 by a suitable film formation process.

In. FIG. 1, only the heater board 101 is illustrated for the sake of easy understanding of the construction of the recording head. Next referring to FIGS. 2A and 2B, an embodiment of a liquid discharging recording head in accordance with the present invention which can be structured by using the heater board 101 of the type describe above.

Figure 2A:
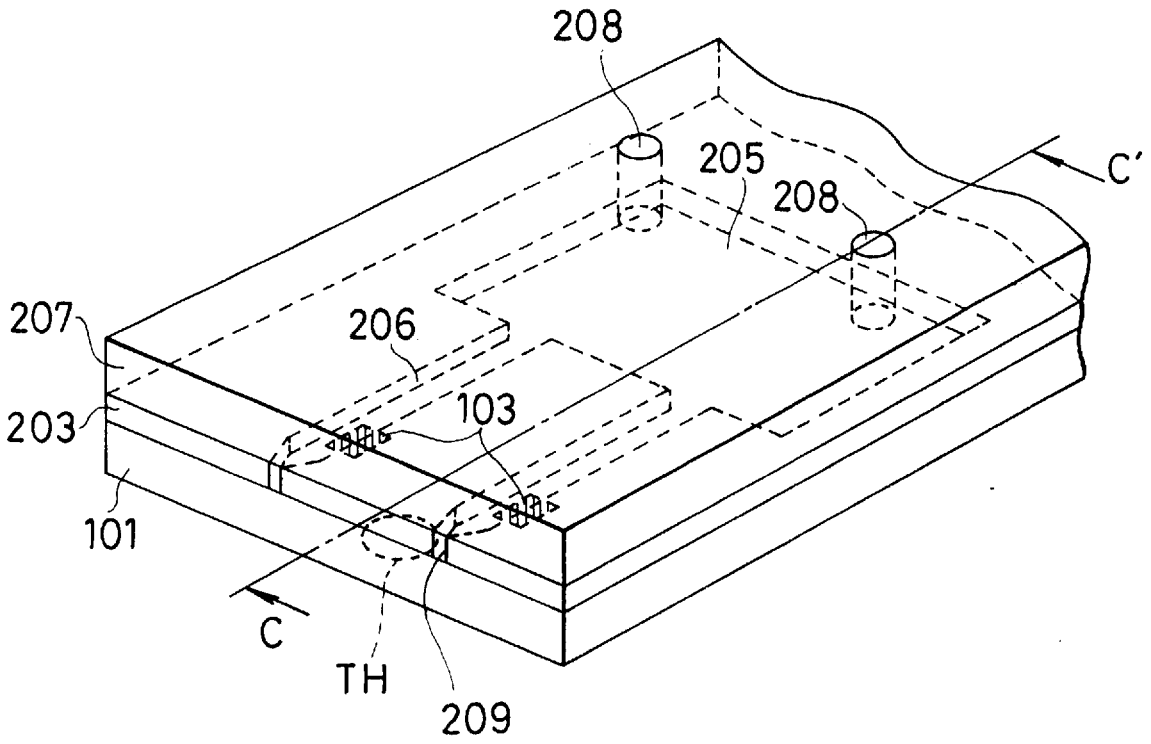
FIGS. 2A and 2B are a perspective view and a longitudinal sectional view, respectively, showing a recording head structure which is conventional in appearance and which can be used with the first embodiment of the liquid discharging recording head fabricated by using the heater board shown in FIG. 1.
Figure 2B:
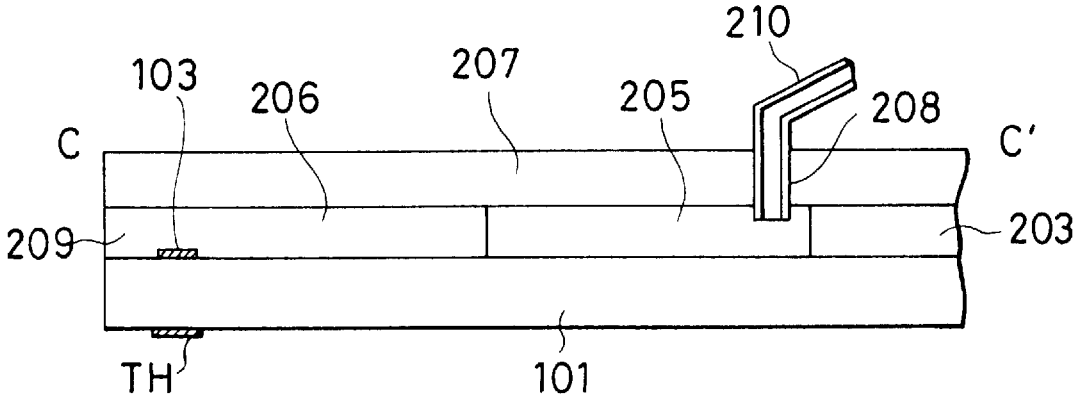

Now referring to FIGS. 2A and 2B, a nozzle plate 203 and a top plate 207 are laminated on the heater board 101 to define recording liquid passages 206. One end of each of the liquid passages 206 defines a discharging orifice communicating with the atmosphere. The other end of the passage 206 is communicated with a recording liquid chamber 205 as an ink supply source. The liquid chamber 205 is communicated with a recording liquid storage tank (not shown) via an ink supply portion 208. In FIG. 2B, the recording liquid is supplied to the liquid chamber 205 through a supply pipe 210 from the recording liquid storage tank. The heaters 102-1 and 102-2 as shown in FIG. 1 are disposed on the opposite sides of the array of the recording liquid discharging heaters 103 on the heater board 101, although the heaters 102-1 and 102-2 are not shown in FIGS. 2A and 2B.

Figure 3A:
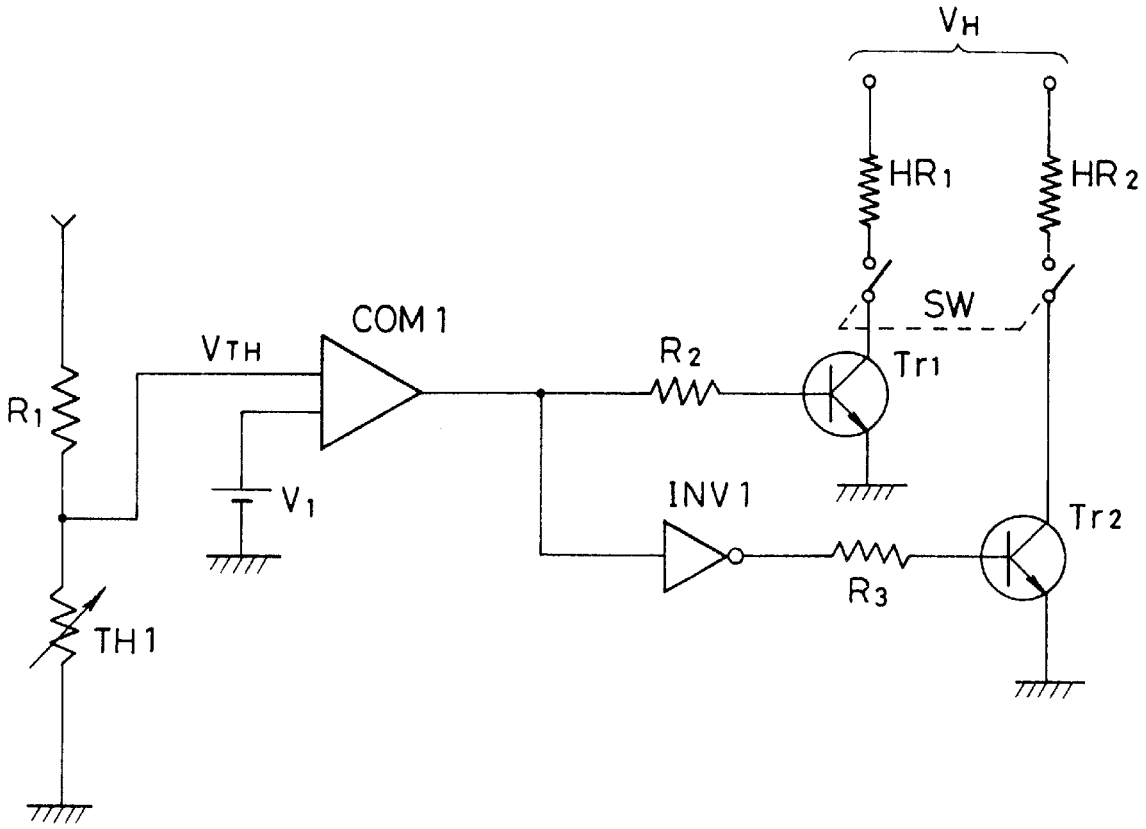
FIGS. 3A and 3B are circuit diagrams showing two embodiments of a heater drive circuit adapted for use with the heater board shown in FIG. 1.
Figure 3B:
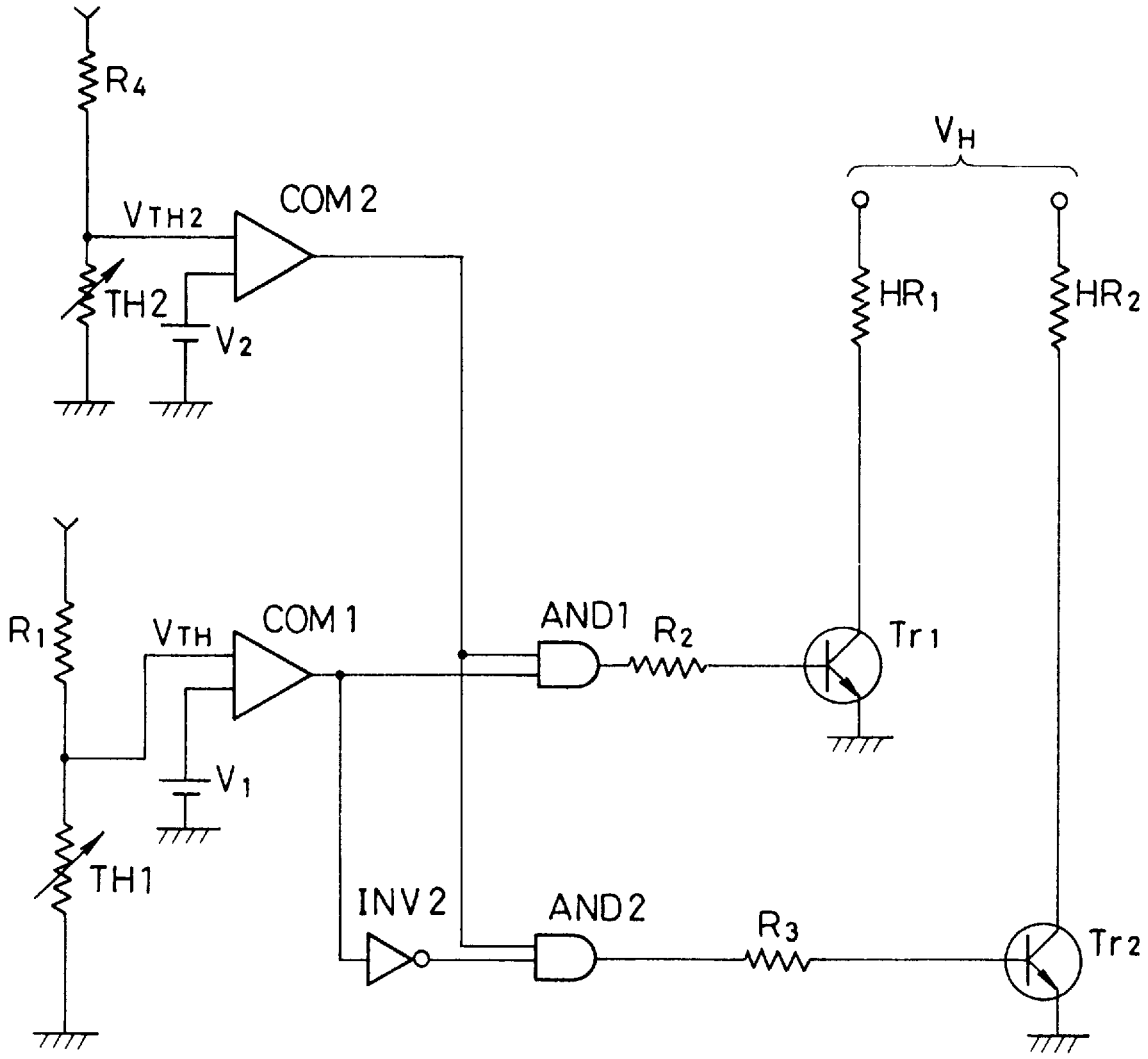

FIGS. 3A and 3B show two embodiments of a circuit for selectively driving the liquid temperature compensation heaters 102-1 and 102-2. The circuit can be arranged in a suitable portion of an apparatus to which the liquid discharging recording head shown in FIGS. 2A and 2B is applied. For example, the head can be provided on a circuit board or substrate mounting a main control unit of the apparatus.

A thermistor TH1 is disposed in a suitable portion of the recording head to sense a temperature of the head. As shown in FIGS. 2A and 2B, the thermistor TH1 is positioned on the rear side of the heater board 101 and in the middle between the discharging heaters 103. Here, the thermistor TH1 is positioned under an area where the heaters 103 aligned. It is of course possible to dispose the thermistor TH1 on the front side of the heater board 101 on both sides of the area of the aligned heaters 103. In this case, the thermistor TH1 can be fabricated together with the heaters 102-1, 102-2 and 103 in the same step.

A voltage $V_{TH}$ obtained from a voltage divider having the thermistor TH1 and the resistor $R_1$ is compared with a reference voltage $V_1$ by a comparator COM1. When $V_1$ is higher than $V_{TH}$, one level signal such as a low level signal is derived from the comparator COM1. When $V_1$ is lower than $V_{TH}$, the other level such as a high level signal is obtained from the comparator COM1.

More specifically, when a temperature of the recording head is low, a resistance value of the thermistor TH1 is high, so that the voltage $V_{TH}$ is also high and consequently the high level signal is derived from the comparator COM1.

The output signal derived from the comparator COM1 is applied as an ON/OFF signal to a transistor Tr1 through a resistor $R_2$. The transistor Tr1 drives or turns on or off the heater 102-1 having a resistance $HR_1$. The output signal from the comparator COM1 is also supplied to an inverter INV1 whose output signal is applied as an ON/OFF signal to a transistor Tr2 through a resistor $R_3$. The transistor Tr2 drives or turns on or off the heater 102-2 having a resistance $R_2$. The transistors Tr1 and Tr2 receive a supply voltage $V_H$ through the heater resistors $HR_1$ and $HR_2$, respectively.

At a low temperature, the voltage $V_{TH}$ is higher than the reference voltage $V_1$, so that the heater 102-1 is energized. As a result, the temperature of the heater board 101 rises. Then, the voltage $V_{TH}$ across the thermistor TH1 becomes lower than the reference voltage $V_1$, so that the heater is de-energized, while the heater 102-2 is energized. Thus, the power consumption is varied, so that the temperature of the heater board or substrate 101 rises gradually.

In order to interrupt a current to be supplied to the heaters 102-1 and 102-2 when the temperature of the substrate 101 rises and exceeds a predetermined temperature, a heat sensitive switch SW is interposed between the heaters 102-1 and 102-2 on the one hand and the transistors Tr1 and Tr2 on the other hand, so that the temperature of the substrate 101 is controlled not to exceed a predetermined temperature. A conventional thermostat can be used as the switch SW, so that the voltage $V_H$ to be supplied to the heaters 102-1 and 102-2 is interrupted.

With the above in view, the circuit shown in FIG. 3A can be modified as shown in FIG. 3B. More particularly, a second thermistor TH2 which may be the same as the thermistor TH1 and a comparator COM2 for comparing the voltage or temperature sensed by the thermistor TH2 with a predetermined temperature value are further provided. An AND gate AND1 outputs an AND output of the output from the comparator COM2 and the output from the COM1. An AND gate AND2 outputs an AND output of the output from the comparator COM2 and the output from an inverter INV2 to which the output from the comparator COM1 is applied. In response to the outputs from the AND gates AND1 and AND2, the transistors Tr1 and Tr2 are turned ON/OFF, respectively, to energize/de-energize the heaters 102-1 and 102-2.

Figure 4:
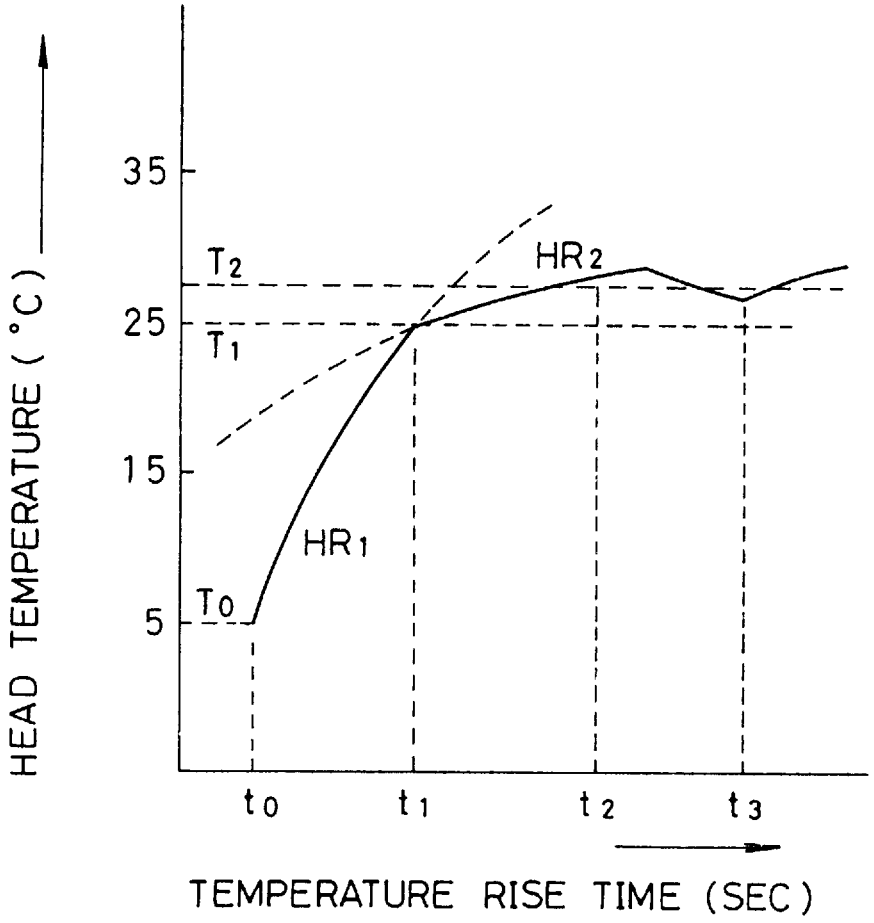
FIG. 4 is an explanatory diagram used to explain the temperature compensation of the recording head.

Next, referring to FIG. 4, the mode of the temperature rise of the substrate 101 will be described. When the temperature $T_0$ of the substrate 101 is low ($V_1<V_{TH}$) at an instant $t_0$, the heater resistor $HR_1$ is energized, so that the substrate 101 is heated to rise its temperature quickly. Thereafter, when the substrate temperature rises to a predetermined temperature $T_1$ ($V_2=V_{TH}$) at an instant $t_2$, the heater resistor $HR_1$ is de-energized, while the heater resistor $HR_2$ is energized, so that the substrate temperature rises slowly.

When the substrate temperature rises and exceeds the upper limit $T_2$ at an instant $t_2$, the switch SW is actuated, so that the current supply to the heater resistor $HR_2$ is interrupted. As a consequence, after some overshoot, the substrate is cooled.

When the substrate temperature falls below the upper limit $T_2$ at an instant $t_3$, the switch SW is actuated again, so that the current flows into the heater resistor $HR_2$. As a result, the heating of the substrate is initiated again to rise the substrate temperature to $T_2$.

Thereafter, the above described operations of the temperature rise and fall are repeated on both sides of the substrate temperature $T_2$, so that the temperature of the recording liquid ejection head is maintained substantially at $T_2$. In this way, the temperature of the recording head can be compensated.

According to the present invention, therefore, even though the power consumption is high at a low temperature, there is obtained an advantage that the substrate temperature rises within a short period of time. Furthermore, since the compensating heater which consumes less energy is energized at a temperature in the vicinity of the compensation temperature, the temperature control can be carried out with a high accuracy and the power consumption can be minimized. According to the present invention, the temperature compensation can be carried out with the above described two advantages.

Next referring to FIG. 5, another embodiment of a heater drive circuit will be described. This heater drive circuit can energize the heaters at a higher degree of accuracy.

The heater drive circuit has three comparators COM1, COM2 and COM3, each having one input terminal connected to a common thermistor TH. Three reference voltages $V_1$, $V_2$ and $V_3$ to be applied to the other input terminals of the comparators COM1, COM2 and COM3 are selected, respectively, with respect to the common thermistor voltage $V_{TH}$ in such a way that (1) when $V_{TH}$ is lower than $V_1$, both of the heaters $HR_1$ and $HR_2$ are simultaneously energized to obtain the maximum quantity of heat, (2) when $V_{TH}$ is between $V_1$ and $V_2$, only the heater $HR_1$ is energized, (3) when $V_{TH}$ is between $V_2$ and $V_3$, only the heater $HR_2$ is energized, and (4) when the voltage $V_{TH}$ is higher than $V_3$, both the heaters $HR_1$ and $HR_2$ are de-energized.

More specifically, the outputs from the comparators COM1 and COM2 are inverted and applied to an AND gate AND1. The output from the comparator COM2 and the inverted output from the comparator COM3 are applied to an AND gate AND2. The outputs from the comparators COM2 and COM3 are inverted and applied to an AND gate AND3. The outputs from the AND gates AND1 and AND2 are applied to an OR gate OR. In response to the output from the OR gate OR, the transistor Tr1 is controlled to be turned on or off. In a like manner, in response to the output from the AND gate AND3, the transistor Tr2 is turned on or off.

Figure 5:
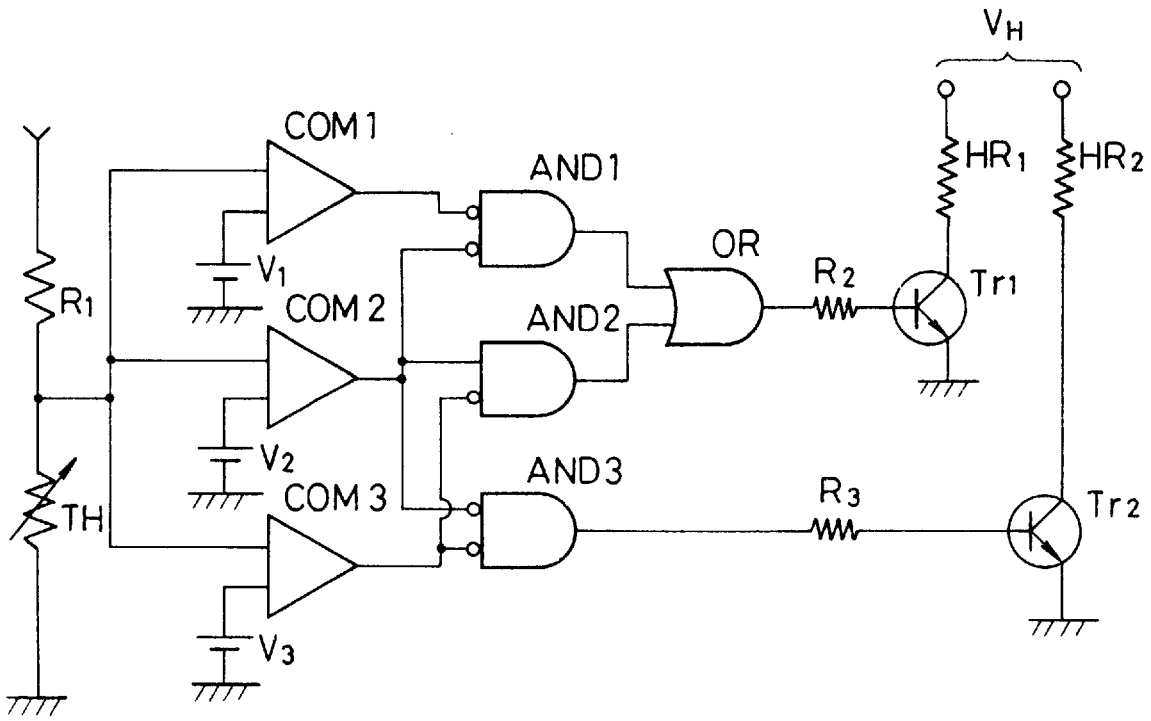
FIG. 5 is a circuit diagram showing a further embodiment of a heater drive circuit.

According to the heater drive circuit shown in FIG. 5 the temperature can be controlled more precisely than the heat drive circuits shown in FIGS. 3A and 3B. Furthermore, while in the heater drive circuit shown in FIG. 3A, the switch SW interrupts the current supply, in the case of the heater drive circuit shown in FIG. 5, the upper limit of the temperature rise of the substrate 101 as shown in FIG. 3A can be controlled by the same circuit, if the reference voltage $V_3$ is selected to be equal to the temperature $T_2$.

Figure 6:
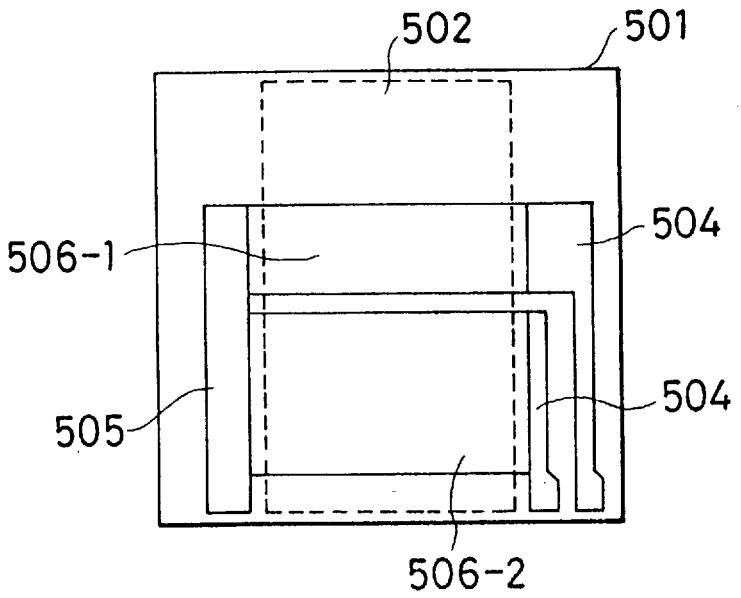
FIGS. 6 and 7 are plan views showing a second and a third embodiment of a heater board in accordance with the present invention.

FIG. 6 shows a heater board or substrate in a further embodiment of the present invention.

In this embodiment, heat generating elements for discharging recording liquid droplets and a connection circuit for supplying electric energy to the heat generating elements are disposed in a portion 502 defined by broken lines on a heater board or substrate 501. Immediately below the portion 502, compensating heaters 506-1 and 506-2 with a common electrode 505 and selection electrodes 504 are disposed on either surface of the substrate 501.

In this embodiment, the compensating heaters 506-1 and 506-2 disposed immediately below the portion 502 can directly heat the recording liquid or ink to be ejected, so that the temperature compensation attained by the present invention can be further enhanced.

In the case of the first embodiment shown in FIG. 1, it is preferable to dispose the compensating heaters 102-1 and 102-2 on both sides of the array of the recording liquid discharging heaters 103 in symmetrical relationship with each other so that a uniform temperature distribution can be obtained. In contrast, in this embodiment, the heaters 506-1 and 506-2 are disposed in the center portion of the heater board 501, so that there is an advantage that uniform heating of the heater board can be attained without the above-described symmetrical relationship.

Figure 7:
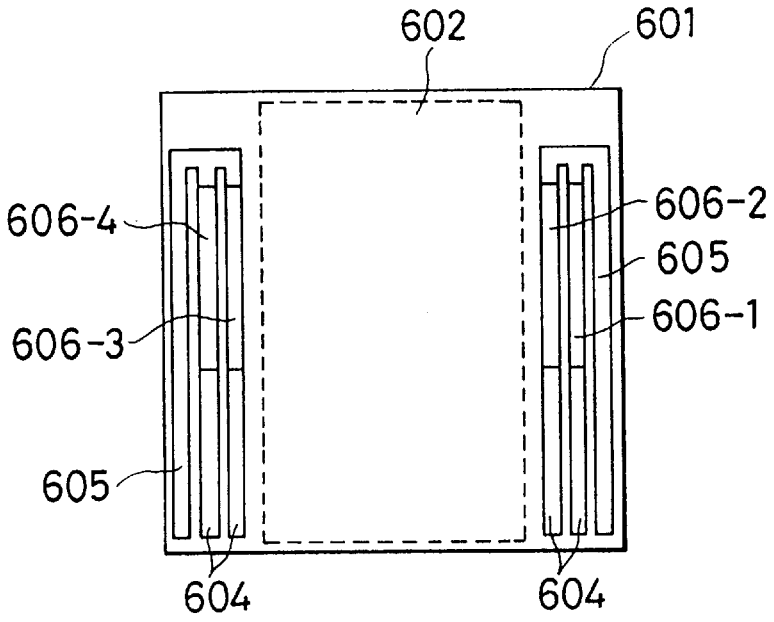

FIG. 7 shows a heater board in a further embodiment of the present invention.

In this embodiment, the recording liquid discharging elements and their associated electrode circuits are disposed in a portion defined by the broken lines on a heater board 601. Heaters 606-1, 606-2, 606-3 and 606-4 with electrodes 604 and 605 are disposed on both sides of the portion 602.

The heaters 606-1, 606-2, 606-3 and 606-4 have resistance values $R_1$, $R_2$, $R_3$ and $R_4$, respectively. Then, a heating energy to be applied to the heater board 601 can be controlled by selectively driving the selection electrodes 604 with respect to the common electrode 605. For instance, when $R_1=R_2=R_3=R_4$ and when the heaters 606-1 through 606-4 are all energized, it is possible to control the thermal energy twice as high as the thermal energy obtained when only the heaters 606-2 and 606-3 or only the heaters 606-1 and 606-4 are energized. Furthermore, when $R_1=R_4$ and $R_2=R_3$, it is possible to control the heating energy at three steps; that is, all the heater 606-1 through 606-4 are energized; only the heaters 606-2 and 606-3 are energized; and only the heaters 606-1 and 606-4 are energized. When resistance values of the heaters 606-1 through 606-4 are varied in this way, it is possible to freely control a temperature of the susbtrate.

While in this embodiment the compensating heaters are selectively driven in accordance with a sensed temperature, an amount of electric power to be supplied to the compensating heaters may alternatively be controlled in accordance with a sensed temperature.

The present invention is particularly useable in an ink jet recording head having thermal energy means for producing thermal energy as energy used for ink ejection such as a plurality of electrothermal transducers, a laser apparatus for generating a plurality of laser beams or the like and a recording apparatus using the head. The thermal energies cause variation of the ink condition thereby eject ink. Therefore, high density of the picture element and high resolution of the recording are possible.

The typical structure and the operational principle are preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on liquid (ink) retaining sheet or ink passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Application Laying-open No. 123670/1984 wherein a common slit is used as the ejection outlet for plurality electrothermal transducers, and to the structure disclosed in Japanese Patent Application Laying-open No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plurality recording head combined to cover the entire width.

In addition, the present invention is applicable to a serial type recording head wherein the recording head is fixed on the main assembly to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means preliminary heating means by the ejection electrothermal transducer or by a combination of the ejection electrothermal transducer and additional heating element and means for preliminary ejection not for the recording operation, which can stabilize the recording operation.

As regards the kinds and the number of the recording heads mounted, a single head corresponding to a single color ink may be equipped, or a plurality of heads corresponding respectively to a plurality of ink materials having different recording color or density may be equipped. The present invention is effectively applicable to an apparatus having at least one of a monochromatic mode solely with main color such as black and a multi-color mode with different color ink materials or a full-color mode by color mixture. The multicolor or full-color mode may be realized by a single recording head unit having a plurality of heads formed integrally or by a combination of a plurality of recording heads.

Furthermore, in the foregoing embodiment, the ink has been liquid. It may, however, be an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Patent Application Laying-open No. 56847/1979 and Japanese Patent Application Laying-open No. 71260/1985. The sheet is faced to the electrothermal transducers. The most effective one for the ink materials described above is the film boiling system.

The ink jet recording apparatus may be used as an output means of various types of information processing apparatus such as a work station, personal or host computer, a word processor, a copying apparatus combined with an image reader, a facsimile machine having functions for transmitting and receiving information, or an optical disc apparatus for recording and/or reproducing information into and/or from an optical disc. These apparatus requires means for outputting processed information in the form of hand copy.

Figure 9:
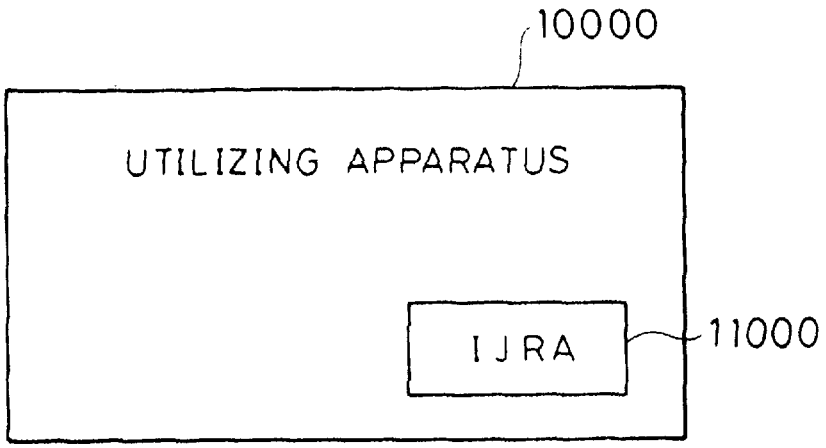
FIG. 9 is a schematic diagram illustrating a recording head structure which is conventional in appearance and which can be used with an embodiment of an apparatus in accordance with the present invention to which the ink discharging recording apparatus shown in FIG. 8 is equipped.

FIG. 9 schematically illustrates one embodiment of a utilizing apparatus in accordance with the present invention to which the ink jet recording apparatus shown in FIG. 8 is equipped as an output means for outputting processed information.

In FIG. 9, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 8. The ink jet recording apparatus (IJRA) 11000 receives processed information from the utilizing apparatus 10000 and provides a print output as hand copy under the control of the utilizing apparatus 10000.

Figure 10:
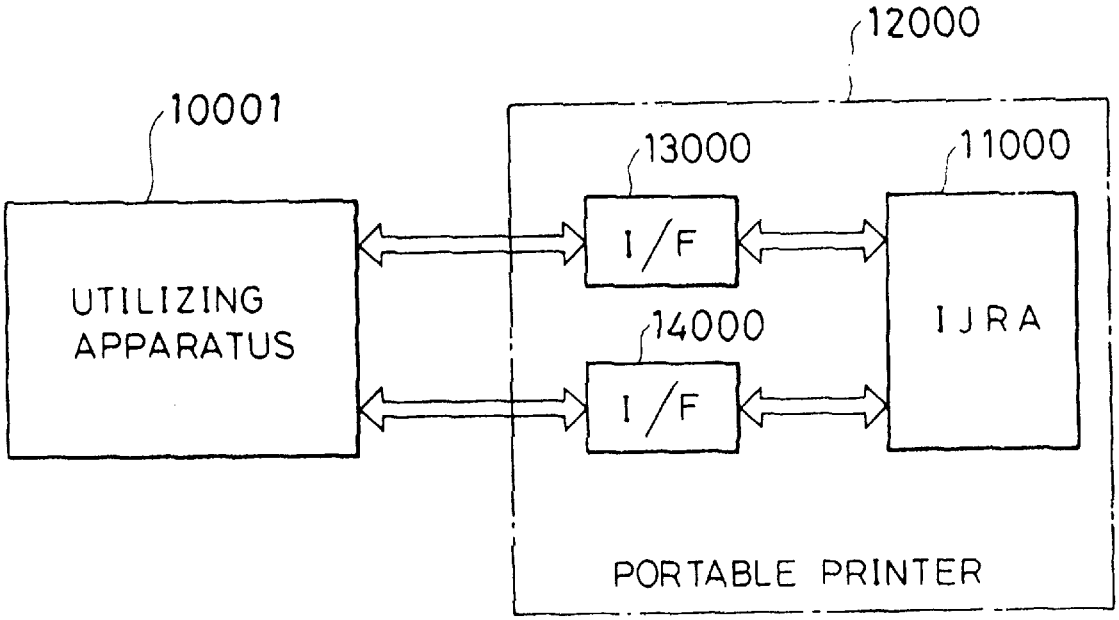
FIG. 10 is a schematic diagram illustrating a recording head structure which is conventional in appearance and which can be used with an embodiment of a portable printer in accordance with the present invention.

FIG. 10 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 10, reference numeral 10001 schematically denotes such a utilizing apparatus. Reference numeral 12000 schematically denotes a portable printer having the ink jet recording apparatus (IJRA) 11000 shown in FIG. 8 which is incorporated thereinto, and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

Although specific embodiments of a record apparatus constructed in accordance with the present invention have been disclosed, it is not intended that the invention be restricted to either the specific configurations or the uses disclosed herein. Modifications may be made in a manner obvious to those skilled in the art.

For example, although the embodiments are described with regard to a serial printer, the present invention can also be applied to line printers. Here, the serial printer is defined as a printer that has a moving member on which the record head is mounted, the moving member being moved to and from in the direction perpendicular to the transporting direction of the recording paper. Accordingly, it is intended that the invention be limited only by the scope of the appended claims.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

As described above, according to the present invention, a plurality of compensating heaters are disposed on a heater board and are selectively energized, so that an energy consumption varies according to the selected energization. As a result, the substrate can be heated efficiently and the temperature compensation can be ensured.

As a result, the temperature can be raised quickly when the temperature of the recording head is low, so that a waiting time before the operation of the liquid discharging recording head can be shortened.

A variation in temperature is small in the vicinity of the temperature compensation region, so that a temperature compensation is precisely controlled. Accordingly, a variation in tone of a recorded image due to overrun can be reduced to minimum.

If the above-described controls are carried out by a single heater, it is required to have means for sequentially controlling a power of the single heater between the maximum power and the minimum power. In contrast, in accordance with the present invention, the two or more compensating heaters are fabricated together with the discharging heating elements in the same substrate, so that the temperature compensation is realized by a simple circuit.

In general, when the temperature of the substrate of the recording head is considerably lower than the temperature compensation region, the printer is in an unused condition while the power source is turned on. Under the condition, the recording operation is not immediately started and the maximum power is applied to the compensating heaters. However, in the temperature compensation region, the power supplied from the power source is divided into the power applied to the discharging heating elements and the power applied to the compensating heaters. In this case, if the power to be applied to the compensating heaters is decreased, a capacity of the electric power source to be supplied to the entire printer can be decreased. As a result, a cost of the entire printer can be reduced.

In summary, the present invention can provide a liquid discharging recording head whose power consumption is small and which can raise the temperature of the recording head even at a low temperature within a short period of time so as to obtain a high quality image.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A temperature compensation apparatus for a liquid discharging recording head, said apparatus comprising:

a substrate having disposed thereon a plurality of energy generating elements for generating energy for discharging a recording liquid and a plurality of elongated liquid passages for supplying the recording liquid defined in part by said substrate and in part by a top plate, each of said liquid passages being provided in correspondence with each of said energy generating elements, respectively, said plurality of energy generating elements and said plurality of liquid passages being aligned on said substrate in a predetermined direction;

a plurality of heating elements each for generating a thermal energy disposed on said substrate for heating said recording liquid, said heating elements being aligned on said substrate in a direction transverse to said predetermined direction and in a direction in which each of said plurality of liquid passages is elongated, said heating elements being selectively energized, wherein more said thermal energy is generated by a given said heating element among said heating elements which is disposed closer to a portion on which said energy generating elements are aligned when a same voltage is applied to all said heating elements;

sensor means for sensing a temperature of said substrate related to a temperature of said recording liquid, said sensor means having at least one thermistor having a thermistor voltage;

comparator means for comparing an output voltage derived from said thermistor voltage with a reference voltage;

control means for selectively energizing said heating elements in response to an output of said comparator means; and interruption means for interrupting said selective energizing of said heating elements when a temperature of said substrate exceeds a predetermined temperature.

2. A temperature compensation apparatus as claimed in claim 1, wherein said interruption means comprises:

a second thermistor for sensing a temperature of said substrate; and second control means for comparing an output from said second thermistor with a second reference voltage to control the interruption of said selective energization of said plurality of heating elements in response to a result of a comparison of said output from said second thermistor with said second reference voltage.

3. A temperature compensation apparatus as claimed in claim 1, wherein said energy generating elements have a plurality of electrothermal conversion elements made of at least one material and said plurality of heating elements include at least said one material.

4. A temperature compensation apparatus as claimed in claim 3, wherein said one material is contained in a heat generating resistance layer.

5. A temperature compensation apparatus as claimed in claim 1, wherein said plurality of heating elements are disposed in the vicinity of said energy generating elements.

6. A recording apparatus as claimed in claim 5, wherein said plurality of heating elements are disposed on said substrate with said energy generating elements between said heating elements.

7. A recording apparatus as claimed in claim 5, wherein said plurality of heating elements are disposed immediately under said energy generating elements.

8. A temperature compensation apparatus for an ink jet recording head, said apparatus comprising:

a substrate having disposed thereon a plurality of energy generating elements for generating energy for discharging an ink and a plurality of elongated ink passages for supplying the ink defined in part by said substrate and in part by a top plate, each of said ink passages being provided in correspondence with each of said energy generating elements, respectively, said plurality of energy generating elements and said plurality of ink passages being aligned on said substrate in a predetermined direction;

a plurality of heating elements each for generating a thermal energy disposed on said substrate for heating the ink, said heating elements being aligned on said substrate in a direction transverse to said predetermined direction and in a direction in which each of said plurality of ink passages is elongated, said heating elements being selectively energized, wherein more said thermal energy is generated by a given said heating element among said heating elements which is disposed closer to a portion on which said energy generating elements are aligned when a same voltage is applied to all said heating elements;

sensor means for sensing a temperature of said substrate related to a temperature of the ink, said sensor means having at least one thermistor having a thermistor voltage;

comparator means for comparing an output voltage derived from said thermistor voltage with a reference voltage;

control means for energizing said heating elements in different drive modes in response to an output of said comparator means; and interruption means for interrupting said energizing of said heating elements when a temperature of said substrate exceeds a predetermined temperature.

9. A temperature compensation apparatus as claimed in claim 8, wherein said interruption means comprises:

a second thermistor for sensing a temperature of said substrates; and second control means for comparing an output from said second thermistor with a second reference voltage to control the interruption of said energization of said plurality of heating elements in response to a result of a comparison of said output from said second thermistor with said second reference voltage.

10. A temperature compensation apparatus as claimed in claim 8, wherein said energy generating elements have a plurality of electrothermal conversion elements made of at least one material and said plurality of heating elements include at least said one material.

11. A temperature compensation apparatus as claimed in claim 10, wherein said one material is contained in a heat generating resistance layer.

12. A temperature compensation apparatus as claimed in claim 8, wherein said plurality of heating elements are disposed in the vicinity of said energy generating elements.

13. A temperature compensation apparatus as claimed in claim 12, wherein said plurality of heating elements are disposed on said substrate with said energy generating elements between said heating elements.

14. A temperature compensation apparatus as claimed in claim 12, wherein said plurality of heating elements are disposed immediately under said energy generating elements.

15. A temperature compensation apparatus as claimed in claim 8, wherein said control means selectively energizes said heating elements, and said heating elements differ from each other in accordance with different responses to an output of said comparator means.

16. A temperature compensation apparatus for an ink jet recording head, said apparatus comprising:

a substrate having disposed thereon a plurality of energy generating elements for generating energy for discharging an ink and a plurality of elongated ink passages for supplying the ink defined in part by said substrate and in part by a top plate, each of said liquid passages being provided in correspondence with each of said energy generating elements, respectively, said plurality of energy generating elements and said plurality of ink passages being aligned on said substrate in a predetermined direction;

a plurality of heating elements each for generating a thermal energy disposed on said substrate for heating the ink, said heating elements being aligned on said substrate in a direction transverse to said predetermined direction and in a direction in which each of said plurality of ink passages is elongated, said heating elements being selectively energized, wherein more said thermal energy is generated by a given said heating element among said heating elements which is disposed closer to a portion on which said energy generating elements are aligned when a same voltage is applied to all said heating elements;

sensor means for sensing a temperature of said substrate related to a temperature of the ink, said sensor means having at least one thermistor having a thermistor voltage;

comparator means for comparing an output voltage derived from said thermistor voltage with a plurality of reference voltages;

control means for energizing said heating elements in different drive modes in response to an output of said comparator means; and interruption means for interrupting said energizing of said heating elements when a temperature of said substrate exceeds a predetermined temperature.

17. A temperature compensation apparatus as claimed in claim 16, wherein said energy generating elements have a plurality of electrothermal conversion elements made of at least one material and said plurality of heating elements include at least said one material.

18. A temperature compensation apparatus as claimed in claim 17, wherein said one material is contained in a heat generating resistance layer.

19. A temperature compensation apparatus as claimed in claim 16, wherein said plurality of heating elements are disposed in the vicinity of said energy generating elements.

20. A temperature compensation apparatus as claimed in claim 19, wherein said plurality of heating elements are disposed on said substrate with said energy generating elements between said heating elements.

21. A temperature compensation apparatus as claimed in claim 19, wherein said plurality of heating elements are disposed immediately under said energy generating elements.

22. A temperature compensation apparatus as claimed in claim 16, wherein said control means selectively energizes said heating elements, and said heating elements differ from each other in accordance with different responses to an output of said comparator means.

23. A recording apparatus for recording an image on a recording medium according to input image data, having a recording head having a plurality of energy generating elements for generating energy for discharging an ink, a plurality of heating elements each for generating a thermal energy for varying the temperature of said recording head, a substrate on which said energy generating elements, a plurality of elongated ink passages for supplying the ink defined in part by said substrate and in part by a top plate, each of said ink passages being provided in correspondence with each of said energy generating elements, respectively, and said heating elements are disposed in a manner such that said energy generating elements and said plurality of ink passages are aligned in a direction transverse to a direction in which said heating elements are aligned, said heating elements being aligned in a direction in which each of said plurality of ink passages is elongated, wherein more said thermal energy is generated by a given said heating element among said heating elements which is disposed closer to a portion on which said energy generating elements are aligned when a same voltage is applied to all said heating elements and sensor means for sensing a temperature of said substrate related to a temperature of the ink, said apparatus comprising:

driving means for driving said energy generating elements with recording signals corresponding to the input image data;

comparing means for comparing the output of said sensor means with a reference value and providing an output signal related to a result of the comparison; and control means for selectively energizing said heating elements in response to the output signal of said comparing means, wherein said control means interrupts said energizing of said heating elements when the output of said sensor means indicates that a temperature of said substrate exceeds a predetermined temperature.

24. A recording apparatus as claimed in claim 23, wherein said energy generating elements have a plurality of electrothermal conversion elements made of at least one material and said plurality of heating elements include at least said one material.

25. A recording apparatus as claimed in claim 24, wherein said one material is contained in a heat generating resistance layer.

26. A recording apparatus as claimed in claim 23, wherein said plurality of heating elements are disposed in the vicinity of said energy generating elements.

27. A recording apparatus as claimed in claim 26, wherein said plurality of heating elements are disposed on said substrate with said energy generating elements between said heating elements.

28. A recording apparatus as claimed in claim 26, wherein said plurality of heating elements are disposed immediately under said energy generating elements.

29. A recording apparatus for recording an image on a recording medium according to input image data having a recording head having a plurality of energy generating elements for generating energy for discharging an ink and a plurality of elongated ink passages for supplying the ink defined in part by said substrate and in part by a top plate, each of said liquid passages being provided in correspondence with each of said of energy generating elements, respectively, a plurality of heating elements each for generating a thermal energy and which are aligned in a direction in which each of said plurality of ink passages is elongated and in a direction transverse to a direction in which said energy generating elements and said plurality of ink passages are aligned for varying the temperature of said recording head, a substrate on which said energy generating elements and said heating elements are disposed, wherein more said thermal energy is generated by a given said heating element among said heating elements which is disposed closer to a portion on which said energy generating elements are aligned when a same voltage is applied across said heating elements, and sensor means for sensing a temperature of said substrate related to a temperature of the ink, said apparatus comprising:

driving means for driving said energy generating elements with recording signals corresponding to the input image data;

comparing means for comparing the output of said sensor means with a reference value and providing an output signal related to a result of the comparison; and control means for selectively energizing said heating elements in response to the output signal of said comparing means.

30. A recording apparatus as claimed in claim 29, wherein said energy generating elements have a plurality of electrothermal conversion elements made of at least one material and said plurality of heating elements include at least said one material.

31. A recording apparatus as claimed in claim 30, wherein said one material is contained in a heat generating resistance layer.

32. A recording apparatus as claimed in claim 29, wherein one of said plurality of heating elements is disposed in the vicinity of said energy generating elements.

33. A recording apparatus as claimed in claim 29, wherein said plurality of heating elements have different energies which are generated when the same voltage is applied to said plurality of heating elements.

34. A recording apparatus as claimed in claim 29, wherein said plurality of heating elements are arranged in a direction crossing a direction in which said energy generating elements are arranged.

35. A recording head comprising:

a plurality of energy generating elements for generating energy for ejecting droplets of an ink;

a plurality of elongated ink passages for supplying the ink defined in part by said substrate and in part by a top plate, each of said ink passages being provided in correspondence with each of said energy generating elements, respectively, said plurality of energy generating elements and said plurality of ink passages being aligned on a substrate in a predetermined direction and disposed on a side of said substrate;

a temperature sensing means for sensing a temperature related to said recording head;

a plurality of temperature compensation heating elements each for generating a thermal energy and which are aligned on said substrate in a direction transverse to said predetermined direction and in a direction in which each of said plurality of ink passages is elongated and wherein more said thermal energy is generated by a given said heating element among said heating elements which is disposed closer to a portion on which said energy generating elements are aligned when a same voltage is applied across said heating elements; and signal input means for inputting a drive signal for selectively driving said plurality of temperature compensation heating elements, said drive signal being generated in response to the temperature sensed by said temperature sensing means.

36. A recording head as claimed in claim 35, wherein said plurality of temperature compensation heating elements are disposed on the same side of said substrate as are said plurality of energy generating elements.

37. A recording head as claimed in claim 36, wherein said plurality of temperature compensation heating elements are disposed on said substrate on both sides of said plurality of energy generating elements.

38. A recording head as claimed in any one of claims 35 to 37, wherein said plurality of temperature compensation heating elements generate thermal energy different from each other when equal electrical energy is applied to said plurality of heating elements.

39. A recording head as claimed in claim 38, wherein a portion of said plurality of temperature compensation heating elements disposed closer to said plurality of energy generating elements generate thermal energy which is greater than that thermal energy which is generated by the rest of said plurality of temperature compensation heating elements when an equal electrical energy is supplied thereto.

40. A recording head as claimed in claim 35, wherein said plurality of temperature compensation heating elements are disposed on a center portion of said substrate.

41. A recording head as claimed in claim 35, wherein said energy generating elements are electrothermal conversion elements which generate thermal energy to cause a change in a state of the ink so that ink droplets are ejected.

42. A recording head as claimed in claim 41, wherein said temperature compensation heating elements are made of a material which is the same as at least part of that of said energy generating elements.

43. A recording head as claimed in claim 42, wherein said at least part of said material is a heat generating resistance layer.

44. A recording head as claimed in any one of claims 35 to 37, wherein said plurality of temperature compensation heating elements are disposed on said substrate on both sides of said plurality of energy generating elements.

45. A recording head as claimed in claim 38, wherein said plurality of temperature compensation heating elements are disposed on said substrate on both sides of said plurality of energy generating elements.

46. A recording head as claimed in claim 39, wherein said plurality of temperature compensation heating elements are disposed on said substrate on both sides of said plurality of energy generating elements.

47. A recording head for an ink jet printer, comprising:

a substrate;

an array of energy generating elements for ejecting an ink, said elements being arranged on said substrate in a row extending along a predetermined direction, said array having a first side and a second side;

a temperature sensing means for sensing a temperature related to a temperature of said substrate, the temperature sensing means having an output;

a plurality of temperature compensation heating elements arranged on said substrate so as to be spaced apart on the substrate in a direction that is transverse to said predetermined direction, including a first temperature compensation heating element and a second compensation heating element; and signal input means for inputting a drive signal for selectively driving said temperature compensation heating elements, said signal being generated in response to the temperature sensed by said temperature sensing means, wherein when a same electrical voltage is applied to said temperature compensation heating elements, said second temperature compensation heating element generates a greater amount of thermal energy than that generated by said first temperature compensation heating elements and said second temperature compensation heating element is disposed nearer to said energy generating elements than said first temperature compensation heating element.

48. A recording head as claimed in claim 47, wherein said plurality of heating elements are disposed on both said first side and said second side of said array of said energy generating elements on said substrate.

49. A recording head as claimed in claim 47, wherein said heating elements comprise a material which is also found in said energy generating elements.

50. A recording head as claimed in claim 49, wherein said material which is also found in said energy generating elements is contained in a heat generating resistance layer.

51. A recording head as claimed in claim 47, wherein said temperature compensation heating elements are disposed immediately beneath said energy generating elements.

52. A recording head as claimed in claim 51, wherein said temperature compensation heating elements are disposed in a central portion of said substrate.

53. A recording head as claimed in claim 47, wherein the energy generating elements are electrothermal conversion elements and said recording head ejects the ink from an orifice by applying the thermal energy generated by said electrothermal conversion elements to the ink so as to cause a change in a state of the ink.

54. An ink jet recording apparatus, comprising:

a recording head, comprising;

a substrate, an array of energy generating elements for ejecting an ink, said elements being arranged on said substrate in a row extending along a predetermined direction, said array having a first side and a second side, a temperature sensing means for sensing a temperature related to a temperature of said substrate, the temperature sensing means having an output, a plurality of temperature compensation heating elements arranged on said substrate so as to be spaced apart on the substrate in a direction that is transverse to said predetermined direction, including a first temperature compensation heating element and a second compensation heating element, and signal input means for inputting a drive signal for selectively driving said temperature compensation heating elements, said signal being generated in response to the temperature sensed by said temperature sensing means, wherein when a same electrical voltage is applied to said temperature compensation heating elements, said second temperature compensation heating element generates a greater amount of thermal energy than that generated by said first temperature compensation heating elements and said second temperature compensation heating element is disposed nearer to said energy generating elements than said first temperature compensation heating element.

55. An ink jet recording apparatus as in claim 54, further comprising a control means which generates the driving signal according to both the output of said temperature sensing means and a reference temperature.

56. An ink jet recording apparatus as in claim 55, wherein said control means generates the driving signal so as to drive selectively said heating elements.

57. An ink jet recording apparatus as in claim 56, wherein said control means generates the driving signal such that said first temperature compensation heating element is driven when the output from said temperature sensing means is lower than the reference temperature, and said second temperature compensation heating element is driven when said output is at least said reference temperature.

58. An ink jet recording apparatus as in claim 57, wherein when a same voltage is applied to said temperature compensation heating elements, said first temperature compensation heating element generates a different amount of energy than that generated by said second temperature compensation heating element.

59. An ink jet recording apparatus as claimed in claim 56, wherein said control means comprises means for interrupting generation of the driving signal for said temperature compensation heating elements when the output from said temperature sensing means is higher than an other reference temperature that is higher than said reference temperature.

60. An ink jet recording apparatus as claimed in claim 56, wherein said control means generates the driving signal in such a manner that at least two said temperature compensation heating elements are driven when the output from said temperature sensing means is equal to or lower than a first reference temperature, said first temperature compensation heating element is driven when said output is higher than said first reference temperature, and said second temperature compensation heating element is driven when said output is higher than a second reference temperature which is higher than said reference temperature.

61. An ink jet recording apparatus as in claim 60, wherein said control means comprises a stopping means for stopping generation of the driving signal for said temperature compensation heating elements when the output from said temperature sensing means is higher than a third reference temperature which is higher than said second reference temperature.

62. An ink jet printer comprising:

a recording head including a substrate, an array of energy generating elements for ejecting an ink, said elements being arranged on the substrate in a row extending along a predetermined direction, at least a first heater and a second heater disposed on the substrate for adjusting a temperature of the substrate, sensing means for sensing the temperature of the substrate, the temperature sensing means having an output, the temperature of the substrate being related to a temperature of the ink in the recording head, and control means arranged to energize the heaters when the output from the sensing means indicates that the temperature sensed is below a predetermined temperature T1, the control means provides the first and second heaters in a manner independent of each other with power, wherein the control means is such that when the output from the sensing means indicates that the temperature sensed is below a value T1 that is less than value T2, the control means either switches from energizing one said heater having a lower heat output to an another said heater having a higher heat output or it switches from energizing one of said first and said second heaters to energizing both said first and said second heaters so that the substrate is heated rapidly when its temperature is less than T1 and more gradually when its temperature is greater than T1.

63. An ink jet printer as claimed in claim 62, wherein the heaters are disposed symmetrically on both said first side and said second side of the array of energy generating elements.

64. An ink jet printer as claimed in claim 62, wherein the heaters are disposed at a region of said substrate in which the heat generating elements are disposed and are disposed on either said face of the substrate immediately beneath the heat generating elements.

65. An ink jet printer as claimed in claim 62, wherein a size and a shape of the heaters is such that when a same voltage is applied to all said heaters, that said heater which is closer to the energy generating elements generates more heat than that said heater which is further from the energy generating elements.

66. An ink jet printer as claimed in claim 65, wherein the control means is arranged to provide power to both the heater which is closer and the heater which is further when the temperature of the recording head is below a first threshold, to provide power only to the heater which is closer when the temperature of the recording head is above the first threshold but below a second threshold higher than the first threshold, and to provide power only to the heater which is further when the temperature of the recording head is above the second threshold.

67. An ink jet printer as claimed in claim 62, wherein the heaters are spaced apart along a direction which is transverse to the predetermined direction of the row of energy generating elements.

68. An ink jet printer as claimed in claim 62, wherein the energy generating elements comprise electrothermal conversion elements for causing a change in a state of the ink so as to eject the ink from an orifice.

69. An ink jet printer as claimed in claim 68, wherein the heaters comprise a material which is also found in the energy generating elements.

70. An ink jet printer as claimed in claim 69, wherein the heaters and the energy generating elements comprise hafnium boride ($HfB_2$).

71. An ink jet printer as claimed in claim 62, wherein the temperature sensing means comprises a thermistor located on the substrate beneath and in the middle of the array of the energy generating elements.

72. An ink jet printer as in claim 62, wherein the temperature sensing means is located at the front of the substrate and comprises either a thermistor located at one side of the array of energy generating elements or a plurality of thermistors located on the first side and the second side of the array of energy generating elements.

73. An ink jet recording apparatus comprising:

a recording head including a plurality of energy generating elements for ejecting an ink and which are arranged along a direction, a first heating element disposed on a substrate on which said energy generating elements is disposed, and a second heating element which is disposed on said substrate and which generates more thermal energy than said first heating element when a same electrical power is supplied to said first and said second heating elements, wherein said second heating element is disposed nearer to said energy generating elements than said first heating element;

detecting means for detecting a temperature of said recording head; and driving means for selectively driving said first and said second heating elements in accordance with the temperature detected by said detecting means, wherein said driving means drives said second heating element when the temperature detected by said detecting means is lower than a predetermined temperature, and drives said first heating element but does not drive said second heating element when the temperature detected by said detection means is higher than said predetermined temperature.

74. An ink jet recording apparatus as claimed in claim 73, wherein said energy generating elements are arranged on said substrate, and said first and said second heating elements are arranged along a direction which is transverse to the direction along which said plurality of energy generating elements are arranged.

75. An ink jet recording apparatus as claimed in claim 74, wherein said energy generating elements comprise electrothermal conversion elements for generating thermal energy when an electric current is supplied to said electrothermal conversion elements, and said first and said second heating elements comprise a material which is also formed in said electrothermal conversion elements.

76. An ink jet recording apparatus as claimed in claim 74, wherein said first and said second heating elements are disposed on both sides of an array of said plurality of energy generating elements.

77. An ink jet recording apparatus as claimed in claim 74, wherein said first and said second heating elements are disposed on a middle of said substrate.

* * * * *

UNITED STATES PATENT AND TRADEMARK OFFICE

CERTIFICATE OF CORRECTION

PATENT NO. : 5,880,753

DATED : March 9, 1999

INVENTOR(S): MASAMI IKEDA, ET AL.

It is certified that error appears in the above-identified patent and that said Letters Patent is hereby corrected as shown below:

Title page, item
AT [56] REFERENCES CITED

FOREIGN PATENT DOCUMENTS

"1299045" should read --1-299045--.

COLUMN 2

Line 20, "response" should be deleted; and
Line 21, "speed of temperature use response" should read --temperature use response speed--.

COLUMN 4

Line 7, "substrates;" should read --substrate;--; and
Line 16, "voltage;" should read -- voltages;--.

UNITED STATES PATENT AND TRADEMARK OFFICE

CERTIFICATE OF CORRECTION

PATENT NO. : 5,880,753

DATED : March 9, 1999

INVENTOR(S): MASAMI IKEDA, ET AL.

It is certified that error appears in the above-identified patent and that said Letters Patent is hereby corrected as shown below:

COLUMN 5

Line 7, "substrates;" should read --substrate;--; and
Line 17, "voltage;" should read --voltages;--.

COLUMN 7

Line 28, "In." should read --In--; and
Line 33, "describe" should read --described--.

COLUMN 10

Line 38, "heater" should read --heaters--; and
Line 67, "such" should be deleted.

COLUMN 12

Line 34, "requires" should read --require--.

UNITED STATES PATENT AND TRADEMARK OFFICE

CERTIFICATE OF CORRECTION

PATENT NO. : 5,880,753

DATED : March 9, 1999

INVENTOR(S): MASAMI IKEDA, ET AL.

It is certified that error appears in the above-identified patent and that said Letters Patent is hereby corrected as shown below:

COLUMN 15

Line 48, "substrates;" should read --substrate;--.

Signed and Sealed this

Fourth Day of January, 2000

*Attest:*

*Attesting Officer*

*Acting Commissioner of Patents and Trademarks*